US007603884B1

(12) United States Patent
Michrina

(10) Patent No.: US 7,603,884 B1
(45) Date of Patent: Oct. 20, 2009

(54) RIGHT ANGLE TRACK CLIP INSTALLATION TOOL

(76) Inventor: Regis Clifford Michrina, 16500 Northville Rd., Plymouth, MI (US) 48170

( * ) Notice: Subject to any disclaimer, the term of this patent is extended or adjusted under 35 U.S.C. 154(b) by 636 days.

(21) Appl. No.: 11/355,021

(22) Filed: Feb. 14, 2006

(51) Int. Cl.
*B25B 7/12* (2006.01)
*B25B 7/00* (2006.01)

(52) U.S. Cl. ..... 72/409.12; 72/409.01; 72/479

(58) Field of Classification Search ..... 72/409.01, 72/409.02, 409.05, 409.08, 409.09, 409.1, 72/409.11, 409.12, 409.15, 409.16, 416, 72/412, 479; 81/348, 350, 351; 305/168, 305/181

See application file for complete search history.

(56) References Cited

OTHER PUBLICATIONS

Internet Advertisement for "Track Clip Tool". Posted on http://www.mfgsupply.com Jan. 28, 2006.
Internet Advertisement for "Track Clip Installation Tool". Posted on http://www.victorspecialtytools.com Jan. 28, 2006.

*Primary Examiner*—Dana Ross
*Assistant Examiner*—Debra M Sullivan
(74) *Attorney, Agent, or Firm*—Steve M. Clemmons

(57) ABSTRACT

The present invention provides a right angle track clip installation tool. The tool includes a pair of handles that are pivotally coupled together and a pair of crimping blocks that are coupled to the handles through ball joints. These ball joints cause the crimping blocks to project from the handles in a generally perpendicular direction. This handle/crimping block arrangement permits a user to install snowmobile track clips to a track without removing the track from the snowmobile.

9 Claims, 3 Drawing Sheets

RIGHT ANGLE TRACK CLIP INSTALLATION TOOL

FIELD OF THE INVENTION

The present invention relates generally to a hand tool and more specifically, a hand tool which allows a user to manually crimp track clips onto a snowmobile track.

BACKGROUND OF THE INVENTION

Snowmobile tracks are driven by rotating sprocket that has protruding lugs that mesh with a series of holes formed in the track. Generally C-shaped metal clips are crimped to the track through adjacent drive holes. These clips prolong the life of the track as they prevent the sprocket from coming into direct contact with the track. These clips also serve as a surface for the suspension slides to run on. As the snowmobile is driven, these clips become worn and have to be replaced. These worn or missing clips must be replaced to avoid premature track damage or breakage.

Currently there are several types of tools and techniques available to snowmobiling enthusiasts which allow them to couple new track clips onto a snowmobile track. These current tools and techniques suffer from several drawbacks.

The first method is to simply use conventional hand tools such as pliers, channel-locks, and hammers to close the clip around the track. This technique suffers from the drawbacks that it is a time-consuming process, the clips may not be properly crimped onto the track, and the track may have to be completely removed from the snowmobile. If the clips are not properly crimped onto the track, the clip may fail prematurely or fall off during use. Having to completely remove the track from the snowmobile to install new track clips further undesirably adds to the time to perform this type of maintenance on the snowmobile. Additionally, removal of the track increases the likelihood of improper track reinstallation which may result in the track breaking during use.

One type of clip installation tool currently available includes a small crimping die which travels along a pair of guide rails. The stationary portion of the tool is placed with the clip in the inside of the track while the movable die portion is disposed on the outer or exterior portion of the tread. The die is actuated by a screw which presses the die into the clip thereby crimping the clip to the track.

This type of tool is undesirable as the die and guide configuration of the tool requires that the tool be disassembled to allow the tool to be inserted through the track holes and then reassembled around the track. After the clip is crimped, the tool must be disassembled again. This increases the time needed to crimp the clip to the track. Additionally, newer style tracks have higher lugs or traction ribs which prohibit the use of this type of tool.

Lastly, a lever type crimping apparatus is available which is generally configured as modified pliers having opposed crimping ends. This type of tool suffers from the drawback that the force needed to crimp track clips require a lever type tool having relatively long moment arms (i.e., handles). This increased length of the prior art handles prevents the tool from being used from the inside of the track unless the track is removed. Crimping the clip from the outer side with such a pliers configuration may result in the clip bending at the incorrect location as there is no support behind the center of the C-shaped clip.

The present invention provides for a tool that overcomes all of the above stated drawbacks of prior art snowmobile track clip installation tools and techniques.

SUMMARY OF THE INVENTION

The present invention provides a new and useful way to install track clips into a snowmobile track that is simpler and quicker in operation than prior art tools and techniques.

The present invention includes two handles that are pivotally coupled together around a ball bearing. Two crimping blocks are coupled to the ends of these handles by ball joints. These ball joints cause the crimping blocks to be oriented generally perpendicular to the handles. The two crimping blocks are also pivotally coupled to each other around another ball bearing.

One non-limiting advantage of the present invention is to provide a crimping tool for coupling a snowmobile track clip to a snowmobile track, the tool comprising of a pair of handles, each having a first and a second end, the handles are interconnected by first pivoting means whereby movement of the first ends toward each other causes the second ends to move apart; a pair of ball joints, wherein each of the ball joints is coupled to one of the handles at the second end; and a pair of crimping blocks, each having a mounting portion and a crimping portion, the crimping blocks are each coupled to one of the ball joints at the mounting portion, the crimping portions having two facing sides which cooperate to define a surface which is complementary to the track clip, the crimping blocks are interconnected by a second pivoting means whereby movement of the mounting portions apart from each other causes the crimping portions to move toward each other.

It is another advantage of the present invention to provide a snowmobile track clip installation tool which allows a user to install track clips onto a track without removing the track from the vehicle.

It is yet another advantage of the present invention to provide a snowmobile track clip installation tool which quickly and securely fastens track clips to a track.

It is still yet another advantage of the present invention to provide a snowmobile track clip installation tool which allows the user to install track clips of different types and sizes onto tracks that require them, by removing the crimping portion of the tool and installing another crimping portion sized for a different track and track clip.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figures 1, 2:
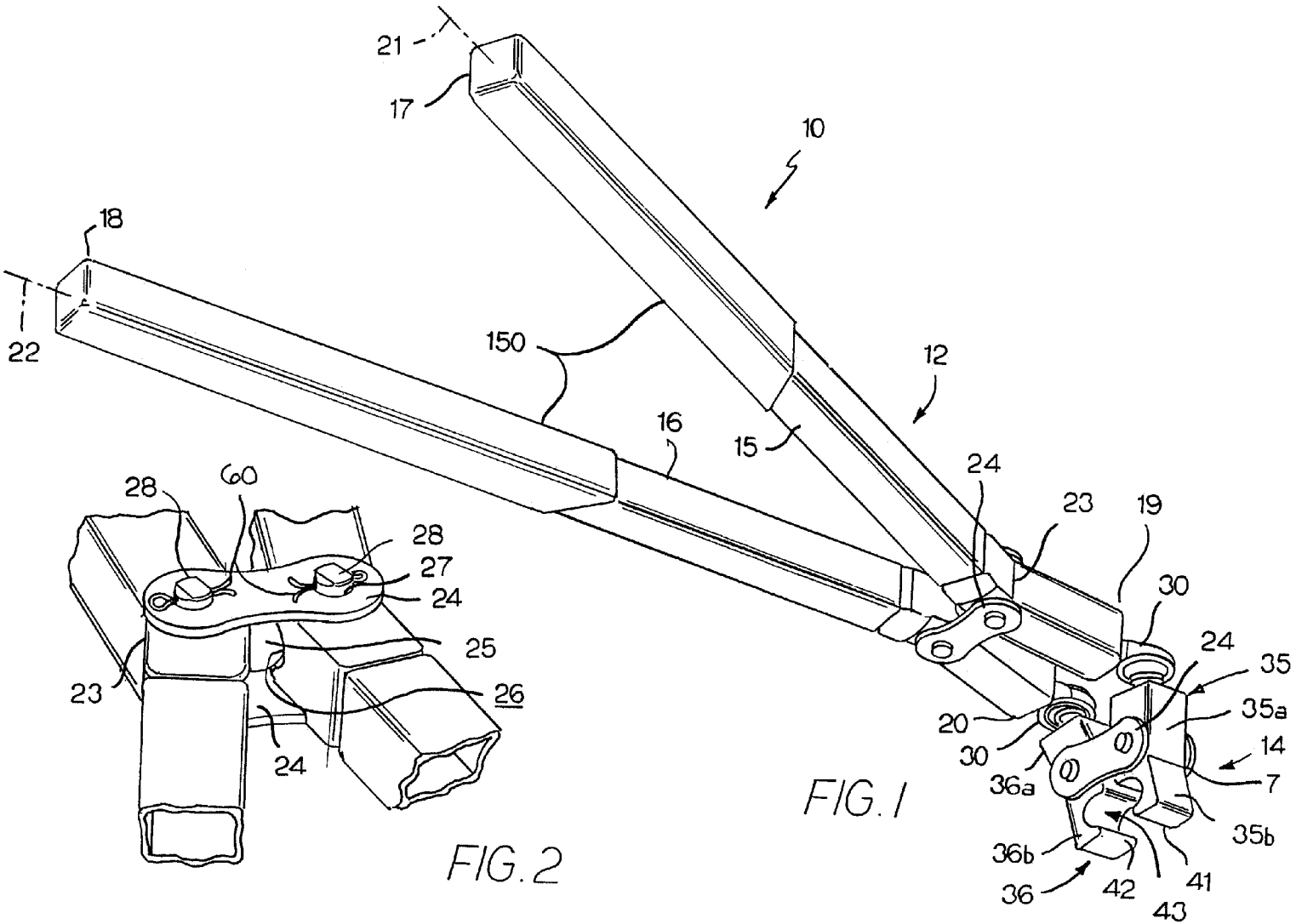
FIG. 1 is a perspective view of a right angle crimping tool in accordance with the preferred embodiment of the present invention.
FIG. 2 is an enlarged partial perspective view of the handle pivoting means of the preferred embodiment of the present invention.
Figure 3:
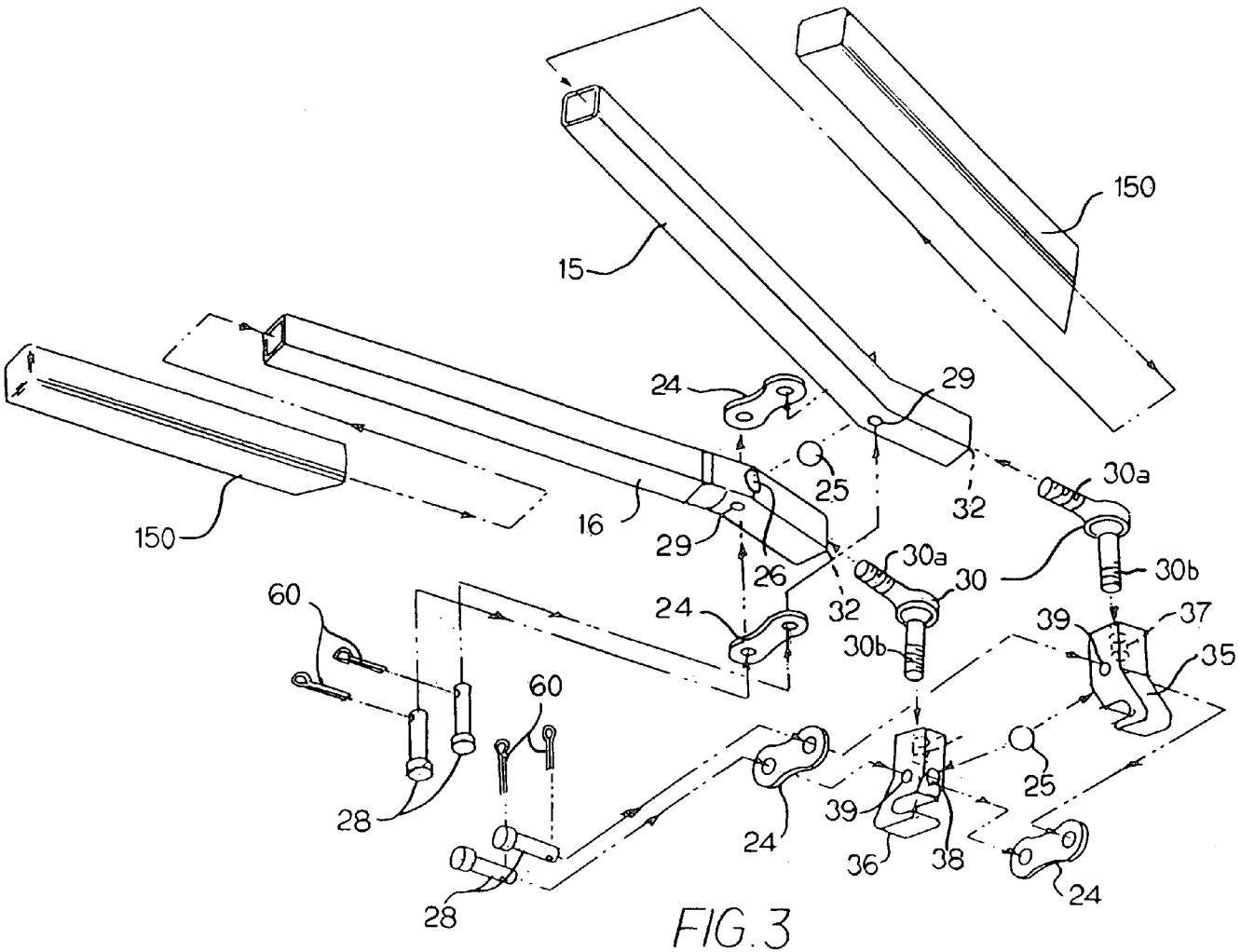
FIG. 3 is an exploded view of the tool shown in FIGS. 1 and 2.

Referring now to FIGS. 1-3, the present invention is directed to a right angle snowmobile track clip installation tool 10. Tool 10 includes a handle portion 12 and a crimping portion 14.

Handle portion 12 includes two identical arms 15, 16. In the preferred embodiment of the invention arms 15, 16 are formed from a strong and rigid material such as steel and have a generally uniform cross-sectional area throughout its length. As shown in FIG. 1, arms 15, 16 are formed from one inch square tube stock. In other embodiments, the cross-sectional shape of the arms may vary, e.g., round, oval, or rectangular. In still other embodiments, the arms 15, 16 are not uniform in cross-sectional area but instead the thickness may vary to reduce material usage and weight.

In the preferred embodiment, arms 15, 16 are approximately two feet in length from the first ends 17, 18 to the second ends 19, 20. As shown, each arm 15, 16 is generally divided into two regions: handle regions 15*a*, 16*a* and angled regions 15*b*, 16*b*. These regions can be differentiated as the arms 15, 16 are bent at a distance approximately four inches away from the second ends 19, 20. This bend 23 causes the angled regions 15*b*, 16*b* and second ends 19, 20 to angle away from the longitudinal axes 21, 22 of the handle regions 15*a*, 16*a*. The regions 15*b*, 16*b* are angled from the handle regions 15*a*, 16*a* by equal amounts and fall within a range of five to thirty degrees. In the preferred embodiment this angle is approximately fifteen degrees.

Referring now to FIG. 2, the handle arms 15, 16 are pivotally coupled together through a pair of pivot links 24 and a ball bearing 25. The arms 15, 16 are oriented relative to each other so that the angled regions 15*b*, 16*b* and end portions 19, 20 are angled apart from each other. These links 24 and ball bearing 25 are coupled to the arms 15, 16 where the arm are bent (i.e., at bend 23).

The ball bearing 25 is seated within two semi-spherical détentes 26 formed in the arms 15, 16. Each détente 26 is formed on the surfaces of the arms 15, 16 facing each other.

The pivot links 24 are formed from wear resistant material, such as hardened steel and have two bores 27 formed through them. The pivot links 24 are pivotally coupled to the arms 15, 16 by two pins 28. Each pin 28 passes through one bore 27 in pivot link 24, through a bore 29 formed through the handle arm and through another link 24 on the opposite side of the arm. The bores 29 are formed substantially co-planar to the center of détente 26 and pass through the surfaces that are perpendicular to the surface having détente 26. In this manner the two links 24 are parallel to each other when the tool 10 is assembled.

In the preferred embodiment, the ends of the pins 28 are pinned by conventional means such as cotter pins 60 to secure the links 24 to the arms 15, 16. The cotter pins 60 allow the link pins 28 to be selectively removed to allow the tool 10 to be selectively disassembled. It should be appreciated that the links 24 are sized to ensure that the ball bearing 25 is secured within the détentes 26 when the handle portion 12 is assembled.

As shown best in FIG. 1, the pivot links 24 and ball bearing 25 are positioned at the bend so that when the arms 15, 16 are pivoted around bearing 25 so that the longitudinal axes 21, 22 are parallel and ends 17, 18 are proximate to each other, the ends 19, 20 are spaced apart. When the ends 17, 18 are spaced apart from each other, the opposite ends 19, 20 are in close proximity to each other.

Tool 10 also includes a pair of conventional ball joints 30. A ball joint 30 is coupled to each arm 15, 16 at the angled ends 19, 20. The ball joints 30 include a socket portion 30*a* and a mating ball portion 30*b* which allows the ball to pivot and rotate within the socket. In the preferred embodiment the socket portions 30*a* of the two ball joints 30 are coupled to the ends 19, 20 of the arms through a threaded engagement. That is, each end 19, 20 has a threaded bore 32 which receives an externally-threaded portion of the socket portion. Each ball joint 30 is oriented relative to the arms 15, 16 so that the socket portion 30*a* is generally collinear with the angled portions of the arms and both of the ball portions 30*b* are facing in the directions generally perpendicular to the socket portion 30*a* and the angled portion of the arms.

The crimping portion 14 of tool 10 includes a pair of identical crimping blocks 35, 36. These crimping blocks are formed from a strong durable material such as steel and are generally rectangular in shape and is approximately six inches long, two inches wide, and one inch thick. The blocks 35, 36 can be described as having two separate regions, mounting regions 35*a*, 36*a* and crimping regions 35*b*, 36*b*. The two regions are generally created by the fact that the rectangular shape is broken by a bend 7 in each of the blocks 35, 36 at the approximate middle of the block. The crimping regions 35*b*, 36*b* are angled from said mounting regions 35*a*, 36*a* at equal angles ranging between two degrees and fifteen degrees. In the preferred embodiment, the crimping regions are angled at approximately five degrees from the longitudinal axis of the mounting regions.

The mounting regions 35*a*, 36*a* are generally uniform in cross-section and provide surfaces for the pivoting means and ball joint to mount to. Particularly, the crimping blocks 35, 36 are each coupled to one of the ball joints 30 at the ball portions 30*b* through a threaded engagement of the ball portion 30*b* within a threaded bore 37 formed in the ends of each of the mounting regions 35*a*, 36*a*. In this manner, the two crimping blocks 35, 36 are generally perpendicular to the plane formed by the two handle arms 15, 16.

The crimping blocks 35, 36 are pivotally coupled to each other in substantially the same way as the arms 15, 16 are. That is, a pair of pivot links 24 and a ball bearing 25 couple the blocks 35, 36 to allow them to pivot and causing the crimping regions 35*b*, 36*b* to open when the mounting regions 35*a*, 36*a* are closed and cause the crimping regions 35*b*, 36*b* to close when the mounting regions 35*a*, 36*a* are opened.

Each crimping block 35, 36 includes a semi-spherical détente 38 on the inward facing surfaces the mounting regions 35*a*, 36*a*. These détentes 38 are sized to receive a portion of the ball bearing 25. Cooperating with ball bearing 25 are the pair of links 24 which are pivotally mounted to the blocks 35, 36 via two pins 28 that pass through bores 39 formed in the mounting regions 35*a*, 36*a* substantially co-planar to the center of détente 38 and pass through the surfaces that are perpendicular to the surface having détente 38.

The crimping regions 35*b*, 36*b* include two surfaces 41, 42 that face each other when the pivot links and bearing couple the blocks together. These two surfaces each have complementary profiles which cooperate to define a generally C-shaped crimping area 43.

Figure 4:
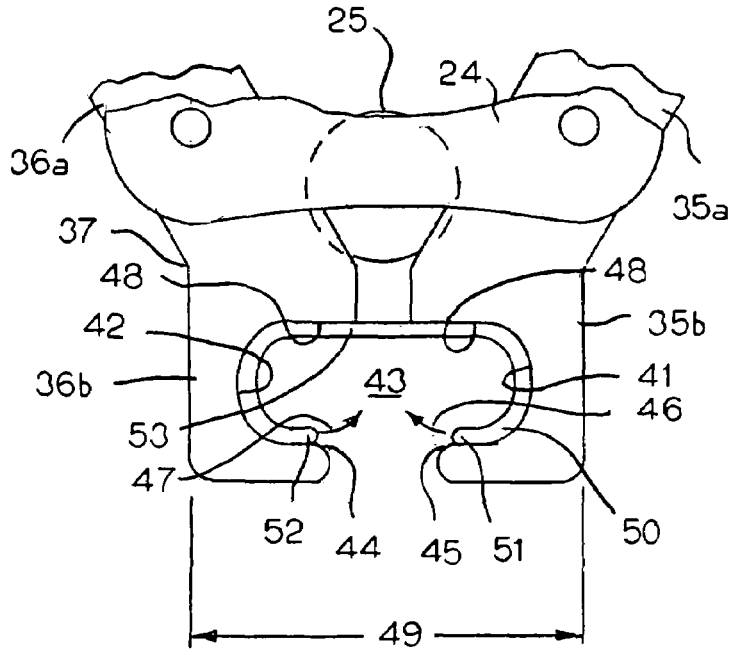
FIG. 4 is a partial front view of the crimping block of the tool shown in FIGS. 1-3 in relationship with a conventional track clip.
Figure 5:
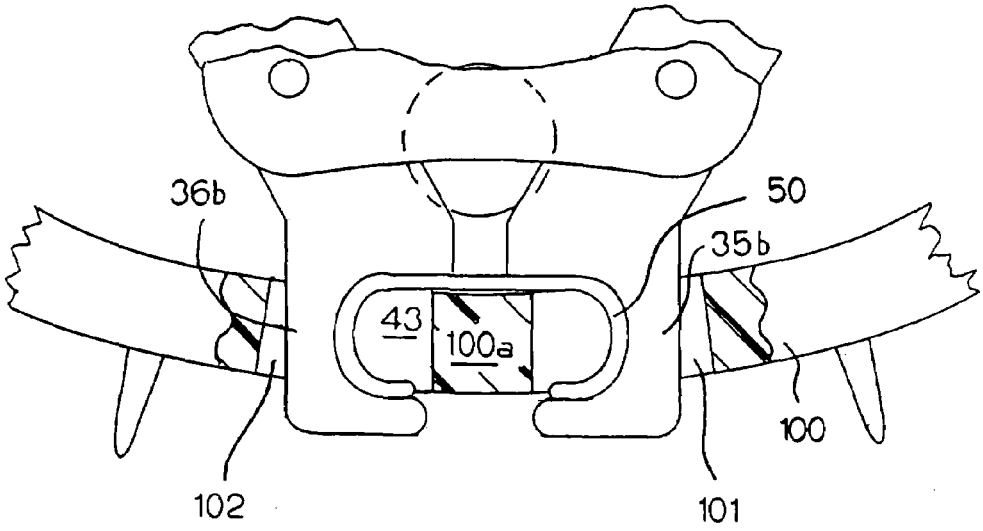
FIG. 5 is a partial front view of the crimping block of the tool shown in FIG. 14 in relationship to a conventional track clip and a section of snowmobile track.

As best shown in FIGS. 4 and 5, the crimping area 43 is shaped to receive a conventional snowmobile track clip 50. The location of the pivot links 24 and ball bearing 25 cause the two edges 44, 45 of the crimping area 43 to rotate in the direction of arrows 46, 47 (i.e., about the spherical ball bearing 25) when the regions 35*b*, 36*b* are closed together. When a track clip 50 is located within area 43 this pivoting causes the edges 44, 45 to bend the ends 51, 52 of the clip 50 in the direction of arrows 46, 47 respectively. This provides that when a clip 50 is pressed onto a track 100, the two ends 51, 52 will be turned up and around the section 100*a* of track 100 it is being crimped to, thereby providing a uniform and secure grip onto the track. As is further shown in FIG. 5, the two crimping regions 35*b*, 36*b* are sized and shaped to fit within adjacent track drive holes 101, 102. It should be appreciated that this crimp block width 49 may vary to accommodate different spacing distances for the drive holes 101, 102 for different tracks 100.

In one embodiment of the invention, a single tool 10 includes a plurality of differently sized and shaped crimp blocks 35, 36 to install differently sized and shaped track clips. Each of these crimping blocks may have a crimping area 43 having a different profile which corresponds to a distinct size or type of track clip and drive hole gap 100*a*.

The description of the invention is merely exemplary in nature and, thus, variations that do not depart from the gist of the invention are intended to be within the scope of the invention. Such variations are not to be regarded as a departure from the spirit and scope of the invention.

For example and without limitation a covering or grip 150 may be placed over the ends 17, 18 of the arms 15, 16 to improve a user grip on the tool 10. Further, different conventional types and styles of pivoting means other than the link/ball bearing combination described above may be used. Still further, the tool 10 described above is not solely limited to manual or hand operation. The tool 10 could be coupled to substantially any conventional means which would automate the opening and closing of crimping blocks 35, 36. For example and without limitation, the arms 15, 16 could be shortened and coupled to a hydraulic ram which would open and close the handle portion 12. In other variations an air gun or hand drill could be coupled to rotate a worm gear/screw that is coupled to the handles 12 to facilitate opening and closing the tool 10.

What is claimed is:

1. A crimping tool for coupling a snowmobile track clip to a snowmobile track, said tool comprising:

a pair of handles, each having a first and a second end, said handles are interconnected by first pivoting means whereby movement of said first ends toward each other causes said second ends to move apart;

a pair of ball joints, wherein each of said ball joints is coupled to one of the handles at said second end; and a pair of crimping blocks, each having a mounting portion and a crimping portion, said crimping blocks and said ball joints are coupled to one another at said mounting portion, said crimping portions having two facing sides which cooperate to define a surface which is complementary to said track clip, said crimping blocks are interconnected by second pivoting means whereby movement of said mounting portions apart from each other causes said crimping portions to move toward each other.

2. The crimping tool of claim 1 wherein said ball joints couple said crimping blocks to said handles so that said crimping blocks are generally perpendicular relative to said handles.

3. The crimping tool of claim 1 wherein each of said handles has an elongated grip portion and a pivot portion, said pivot portion is at an angle from a longitudinal axis of said grip portion.

4. The crimping tool of claim 3 wherein said crimping portions are angled out from said mounting portions.

5. The crimping tool of claim 3 wherein said first pivoting means is coupled to said pair of handles at said pivot portions.

6. The crimping tool of claim 1 wherein said first and second pivoting means each comprise a ball bearing and two pivot links.

7. The crimping tool of claim 1 wherein said handles have a generally uniform cross-sectional area.

8. A crimping tool for coupling a snowmobile track clip between adjacent track drive hole's along a snowmobile track, said tool comprising:

a pair of elongated handles, each having a first and a second end, said handles are interconnected by first pivoting means whereby movement of said first ends toward each other causes said second ends to move apart;

a pair of ball joints, wherein each of said ball joints depends from one of the handles at said second end; and a pair of crimping blocks, each having a mounting portion and a crimping portion, said crimping blocks and said ball joints are coupled to one another at said mounting portion, each crimping portion is sized to fit within one of said drive holes, said crimping portions having two facing sides which cooperate to define a surface which is complementary to said track clip, said crimping blocks are interconnected by second pivoting means whereby movement of said mounting portions apart from each other causes said facing sides to move toward each other.

9. The crimping tool of claim 8 wherein said ball joints couple said crimping blocks to said handles such that said crimping blocks extend perpendicularly away from said handles.

* * * * *